US012709953B2

(12) United States Patent
Robertson et al.

(10) Patent No.: US 12,709,953 B2
(45) **Date of Patent: *Aug. 18, 2026**

(54) SYSTEMS AND METHODS FOR ACTIVATING A PRESSURE-SENSITIVE DOWNHOLE TOOL

(71) Applicant: Robertson Intellectual Properties, LLC, Mansfield, TX (US)

(72) Inventors: Michael C. Robertson, Mansfield, TX (US); Douglas J. Streibich, Fort Worth, TX (US); Antony F. Grattan, Mansfield, TX (US)

(73) Assignee: Robertson Intellectual Properties, LLC, Mansfield, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/002,052

(22) Filed: Dec. 26, 2024

(65) Prior Publication Data

US 2025/0129681 A1 Apr. 24, 2025

Related U.S. Application Data

(63) Continuation of application No. 17/838,856, filed on Jun. 13, 2022, now Pat. No. 12,180,796.

(Continued)

(51) Int. Cl.

*E21B 23/04* (2006.01)
*E21B 34/06* (2006.01)

(Continued)

(52) U.S. Cl.

CPC ..... *E21B 23/0413* (2020.05); *E21B 34/063* (2013.01); *E21B 23/04* (2013.01); *E21B 34/142* (2020.05); *E21B 43/11* (2013.01)

(58) Field of Classification Search

CPC .. E21B 23/0413; E21B 34/063; E21B 34/142; E21B 23/04; E21B 43/11

See application file for complete search history.

(56) References Cited

U.S. PATENT DOCUMENTS 5,005,641 A * 4/1991 Mohaupt ..... E21B 43/263 166/63
5,890,539 A * 4/1999 Huber ..... E21B 43/11852 166/297

(Continued)

*Primary Examiner* — Neel Girish Patel
(74) *Attorney, Agent, or Firm* — McCutcheon Joseph, PLLC

(57) ABSTRACT

Apparatus, systems, and methods are used for activating a downhole tool, powered by an exothermic reaction, for operation, while deploying a tubing string from a wellbore surface. The tubing string comprises a coupling for enabling pressurized activation of the downhole tool, which comprises a fuel (e.g., thermite) for producing the exothermic reaction. The coupling enables fluid to flow into an interior of the coupling through a first flow passage, during descent of the downhole tool. A stopper is dropped and/or seated to cause the coupling interior to pressurize to an activation pressure, which causes an activator to activate a burn within the downhole tool. Once the downhole tool completes its operation, the coupling interior is further pressurized to burst a burst disc, which opens a second flow passage for fluid to flow from the interior to exterior of the coupling, while downhole tool and coupling are raised to the surface.

16 Claims, 3 Drawing Sheets

Related U.S. Application Data

(60) Provisional application No. 63/210,378, filed on Jun. 14, 2021.

(51) Int. Cl.
*E21B 34/14* (2006.01)
*E21B 43/11* (2006.01)

(56) References Cited

U.S. PATENT DOCUMENTS 6,138,753 A * 10/2000 Mohaupt ..... E21B 43/25 166/299
11,274,519 B1 * 3/2022 Helms ..... E21B 33/14
11,834,919 B2 * 12/2023 Schultz ..... E21B 23/0413
2002/0162661 A1 * 11/2002 Krauss ..... E21B 34/142 166/318
2004/0055755 A1 * 3/2004 Roesner ..... E21B 23/06 166/120
2006/0005998 A1 * 1/2006 Grattan ..... E21B 29/02 175/4.6
2012/0217014 A1 * 8/2012 Groves ..... E21B 43/26 166/308.1
2014/0060839 A1 * 3/2014 Wang ..... E21B 43/117 166/299
2014/0246209 A1 * 9/2014 Themig ..... E21B 34/142 166/194
2014/0299330 A1 * 10/2014 Fripp ..... E21B 43/12 166/373
2015/0260012 A1 * 9/2015 Themig ..... E21B 34/142 166/317
2015/0308229 A1 * 10/2015 Patton ..... E21B 33/12 166/185
2017/0335646 A1 * 11/2017 Huang ..... E21B 43/114
2019/0186243 A1 * 6/2019 Huang ..... E21B 43/1185
2019/0323310 A1 * 10/2019 Robertson ..... E21B 23/02
2020/0362675 A1 * 11/2020 Anderson ..... E21B 34/142
2022/0220819 A1 * 7/2022 Schultz ..... E21B 23/0413

* cited by examiner

SYSTEMS AND METHODS FOR ACTIVATING A PRESSURE-SENSITIVE DOWNHOLE TOOL

CROSS REFERENCE TO RELATED APPLICATIONS

The present application is a continuation of and claims priority to U.S. patent application Ser. No. 17/838,856, titled "Systems and Methods for Activating a Pressure-Sensitive Downhole Tool," filed on Jun. 13, 2022, which is a nonprovisional of and claims priority to U.S. Provisional Patent Application No. 63/210,378, titled "Systems and Methods for Activating a Pressure-Sensitive Downhole Tool," filed on Jun. 14, 2021. The disclosures of the prior applications are hereby incorporated by reference herein in their entirety.

FIELD

Embodiments usable within the scope of the present disclosure relate, generally, to apparatus, systems, and methods for activating a downhole tool through pressurization of a tubing string. And more particularly, activating an exothermic or thermite powered downhole tool while deploying the tubing string dry from the surface of the wellbore.

BACKGROUND

Many wellbore operations necessitate deploying a downhole tool within a wellbore. Some operations may be accomplished through explosive charges, drill bits, pressurized fluid from the surface of the wellbore, or other high-energy and high-impact devices and methods. Other operations may require downhole tools capable of performing precise or delicate jobs. For such operations, a non-explosive downhole tool is preferred. Such downhole tools include, for example, torches, perforator systems, setting tools, fracturing equipment, and the like (collectively referred to herein as downhole tools) that can be powered through the use of a fuel such as thermite, which comprises at least a metal and an oxidizer.

A need exists, in the oil and gas industry, for the ability to activate such downhole tools at an optional time preferred by the operator at the surface. Tools that are powered through exothermic reactions, including non-explosive tools, have been activated in a number of ways in the past. For example, timers may be used in some circumstances to activate the downhole tool after a certain time has elapsed. The time may be between several hours, days, or even weeks. This gives the rig crew time to perform other operations before the particular downhole tool is activated. Other downhole tools may be activated under a specific set of conditions. Downhole tools, with such activators, detect and record conditions such as pressure, temperature, and the amount of time spent in these conditions. The downhole tool may be programmed to activate when a specific set of conditions is detected. For example, if the activator experiences a combination of temperature and pressure for at least ten minutes, then the activator will activate the downhole tool.

Non-explosive tools, however, have not been equipped, thus far, with activators that allow the operator to determine the moment of activation from the surface. Therefore, a need exists for operators to activate a downhole tool when desired, such as when the downhole tool is deployed at the end of a tubing string.

The present embodiments meet these needs.

SUMMARY

Embodiments of the present invention include apparatus, systems and methods usable to accurately activate packers, cutters, torches, perforator systems, setting tools, and/or other types of tools used downhole.

The disclosed embodiments include a system for lowering a downhole tool into a wellbore, wherein the system can comprise a tubing string coupling for use on a tubing string to be lowered into the wellbore. The tubing string coupling can comprise a first flow passage that can fluidly connect an interior of the tubing string coupling with an exterior of the tubing string coupling. The interior can be configured to have an internal pressure while the exterior can have an external pressure, wherein the first flow passage can comprise a stopper seat that can be configured to hold a stopper, e.g., a ball, a plug, a seal, or other device for halting or obstructing flow, that can block the flow from the interior of the tubing string coupling to the exterior of the tubing string coupling. The tubing string coupling can further comprise a pressure passage that can be configured to convey the internal pressure from within the interior of the tubing string coupling, and a second flow passage that can fluidly connect the interior of the tubing string coupling with the exterior of the tubing string coupling. In addition to the tubing string coupling, the system can further comprise a pressure-initiated activator that can be configured to receive the internal pressure from the pressure passage, wherein the pressure-initiated activator can be configured to activate the downhole tool at an activation pressure.

In an embodiment, the system can comprise a downhole tool that comprises a perforator system, a torch, a setting tool, or combinations thereof, and the downhole tool can comprise a fuel, such as thermite or other fuel that, when ignited, produces a nonexplosive or exothermic reaction.

Embodiments of the system can comprise a rig that can be configured to lower the tubing string, comprising the tubing string coupling and the pressure-initiated activator, into the wellbore. In an embodiment, the tubing string coupling can comprise a burst disc blocking the second flow passage, wherein the burst disc can be configured to rupture at a burst pressure that is higher than the activation pressure.

Embodiments of the present invention can include a method of activating a downhole tool in a wellbore, wherein the method comprises the steps of: lowering a tubing string coupling into the wellbore via a tubing string, and allowing fluid to flow into an interior of the tubing string coupling from an exterior of the tubing string coupling via a first flow passage, wherein the interior comprises an interior pressure and the exterior comprises an exterior pressure. The method steps can continue by blocking the first flow passage with a stopper, pressurizing the interior of the tubing string coupling to increase the interior pressure to an activation pressure, and activating a pressure-initiated activator, which can be connected via a passage to the interior of the tubing string coupling when the interior pressure reaches the activation pressure to activate the downhole tool.

In an embodiment, the downhole tool can comprise a perforator system, a torch, a setting tool, or combinations thereof. In an embodiment, the method can comprise activating, with the pressure-initiated activator, a thermite or other fuel that, when ignited, can produce a non-explosive or exothermic reaction within the downhole tool.

In an embodiment, the step of blocking the first flow passage can comprise dropping or seating the stopper, e.g., a ball, a plug, a seal or other device that can halt or block flow, into the tubing string coupling.

In an embodiment, the tubing string coupling can comprise a burst disc that can be usable for blocking a second flow passage that can be configured to fluidly connect the interior of the tubing string coupling with the exterior of the tubing string coupling. The steps of the method can further comprise increasing the interior pressure to a value higher than the activation pressure to rupture the burst disc. In an embodiment, the method can comprise retrieving the downhole tool, after rupturing the burst disc, while fluid passes from the interior of the tubing string coupling to the exterior of the tubing string coupling through the second flow passage. After the downhole tool is retrieved, the steps of the method can further comprise removing the stopper, replacing the burst disc, and lowering the tubing string and the tubing string coupling into the wellbore.

Embodiments of the present invention can include a tubing string coupling for use on a tubing string within a wellbore, wherein the tubing string coupling can comprise: a first flow passage that can fluidly connect an interior of the tubing string coupling with an exterior of the tubing string coupling, and the interior is configured to have an internal pressure while the exterior is configured to have an external pressure. The first flow passage can comprise a stopper seat that can be configured to hold a stopper, which can be usable to block the first flow passage to obstruct flow from the interior of the tubing string coupling to the exterior of the tubing string coupling. The tubing string coupling can comprise a pressure passage that can be configured to convey the internal pressure from within the interior of the tubing string coupling to a pressure-initiated activator, wherein the pressure-initiated activator is configured to activate a downhole tool at an activation pressure, and a second flow passage that can fluidly connect the interior of the tubing string coupling with the exterior of the tubing string coupling. In an embodiment, the tubing string coupling can further comprise a burst disc that can be usable for blocking the second flow passage, wherein the burst disc can be configured to rupture at a burst pressure that is higher than the activation pressure. In an embodiment, the stopper seat can be configured to hold a ball-shaped stopper.

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed FIGS.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
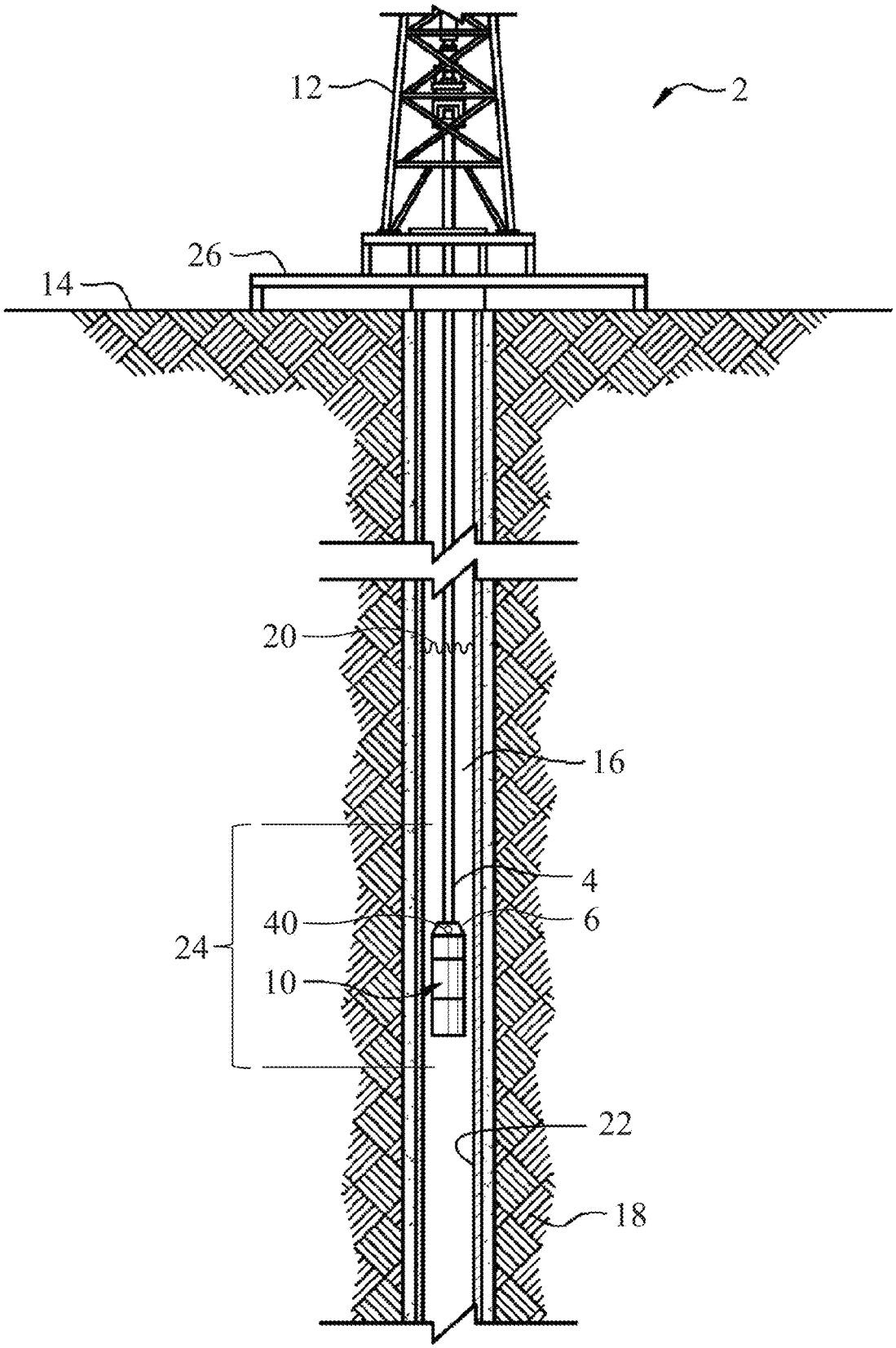
FIG. 1 illustrates a schematic view of a possible operating environment for a downhole tool having a tubing string coupling.

FIG. 1 illustrates a schematic view of a possible operating environment for a downhole operation system 2. The system 2 may include a tubing string 4, a tubing string coupling 6, and a downhole tool 10. The downhole tool 10 may be, or may include, a variety of tools used to perform an exothermic (non-explosive) operation. The downhole tool 10, for example, may also include thermite fuel, which comprises a mix or combination of a metal and an oxidizer for oxidizing the metal, to perform operations underground. To lower the downhole tool 10 for the operation, the system 2 may include above-ground components, such as a rig 12 positioned on a surface 14 of a wellbore 16. As illustrated, the rig 12 may be positioned on the surface 14 of solid land, and used to perform operations on a completed wellbore 16. In certain embodiments, the rig 12 may also include drilling equipment for drilling and/or extending the wellbore 16. In an embodiment, the rig 12 can be located at sea for operations associated with offshore extraction of hydrocarbons. Additionally or alternatively, the rig 12 can be a temporary structure constructed for the purpose of completing the operation, or may include servicing or pumping equipment that is semi-permanently installed on the surface 14 for continued operations performed within the wellbore 16.

The wellbore 16 may penetrate through a subterranean formation 18 (or several) for the purpose of recovering hydrocarbons. The formation 18 may include fluid 20 (e.g., production fluid, hydrocarbons, natural gas, water, or other fluids) that can flow into the wellbore 16. The fluid 20 may be extracted to the surface 14 for treatment, and/or distribution.

In certain embodiments, the fluid 20 may include components that are not for production, but have flooded the wellbore 16 to a point above an operation location 24 where the downhole tool 10 is supposed to complete the operation. For example, the operation location 24 may include removal of designated portions of casing 22, perforation of the casing 22, or securement of one or more permanent or semi-permanent structures within the operation location 24, which can create a situation whereby such fluid 20 could enter the wellbore 16.

As shown in FIG. 1, the drilling rig 12 includes a rig floor 26 through which the tubing string 4 can extend downwardly from the drilling rig 12 into the wellbore 16. As stated above, the rig 12 and the rig floor 26 may be located at sea for offshore operations. The tubing string 4 may include any form of well tubing, such as jointed pipe, or coiled tubing. As shown in FIG. 1, the tubing string 4 suspends the downhole tool 10, which may comprise a radial torch, an axial torch, a frac plug, a bridge plug, a packer, a setting tool, or another type of wellbore tool, for example, as it is being lowered within the wellbore 16 to perform a specific operation.

While the exemplary operating environment depicted in FIG. 1 refers to a stationary drilling rig 12 for lowering and setting the downhole tool 10, which is to be consumed downhole, within a land-based wellbore 16, one of ordinary skill in the art will readily appreciate that mobile workover rigs, well servicing units, and the like, could also be used to lower the downhole tool 10 into the wellbore 16. It should be understood that the consumable downhole tool 10 can be used in other operational environments, such as within an offshore well bore. The tubing string coupling 6 may be especially useful in offshore wellbores, due to the presence of extra fluid (e.g., sea water) that may flood certain parts of the wellbore 16. As explained in detail below, as the tubing string 4 is lowered into the wellbore 16 through the fluid 20, without any need to pump in extra fluid from the surface 14.

Figure 2:
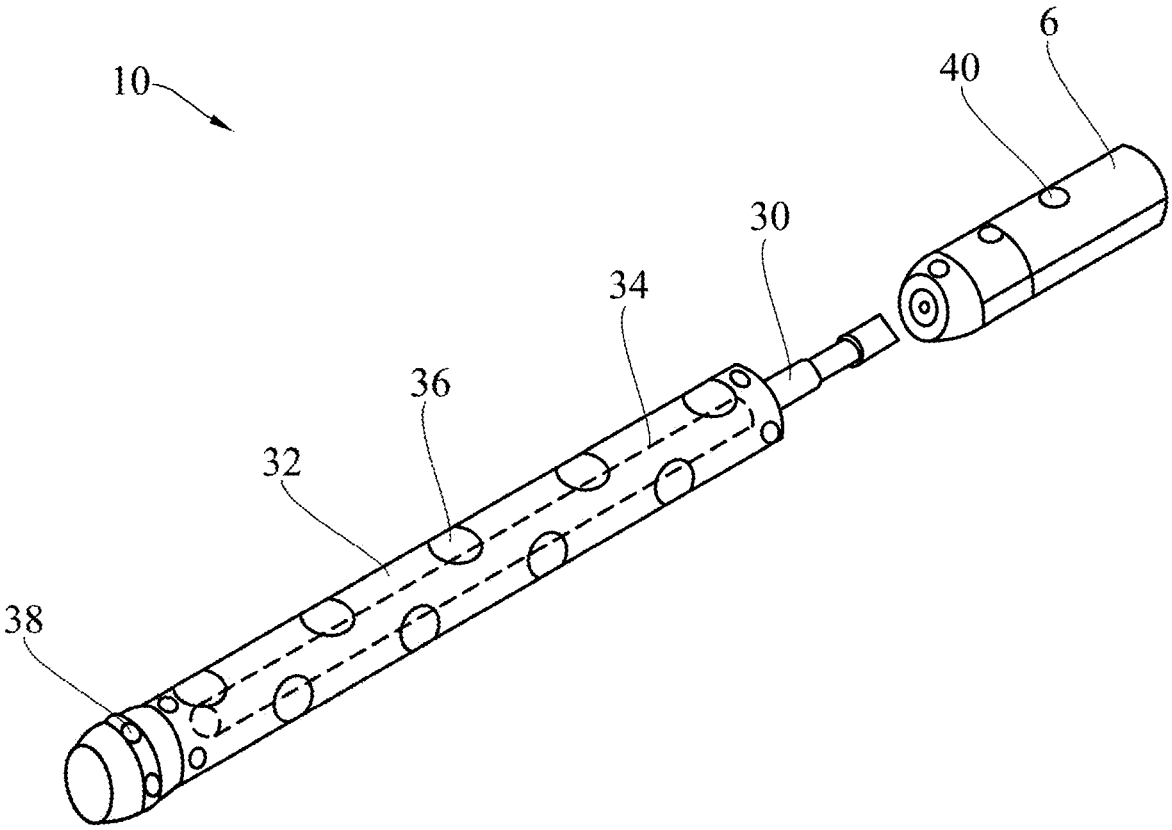
FIG. 2 illustrates an exploded view of an embodiment of the downhole tool that may be deployed within the wellbore.

FIG. 2 illustrates an embodiment of the downhole tool 10 that may be deployed within the wellbore 16. The downhole tool 10, as shown, includes the tubing string coupling 6 that connects the downhole tool 10 to the tubing string 4 (shown in FIG. 1). As shown, the downhole tool 10 can comprise a pressure-initiated activator 30 and a fuel-storage body 32. The pressure-initiated activator 30 can comprise a pressure-sensitive electronic circuit that can activate a burn of fuel 34, which can be stored within the fuel-storage body 32. As mentioned above, the fuel 34 may include a thermite or thermite mixture that activates an exothermic reaction, which results in molten fuel.

Thermite is a combination or a mixing that includes a metal and an oxidizer. When the oxidizer combines or mixes with the metal, e.g., during an exothermic reaction, a metal oxide can be created that forms, or partially forms, a combustion product(s). Examples of such metals that can be used in thermite or a thermite combination include: aluminum, magnesium, chromium, nickel, silver, molybdenum, titanium, zinc, silicon and/or other metals. Examples of an oxidizer, which is capable of oxidizing the metal, can include: cupric oxide, iron oxide, aluminum oxide, chromium oxide, manganese oxide, silicon dioxide, ammonium perchlorate, and other oxidizers. The ignition point of thermite can vary, depending on the specific composition of the thermite combination. For example, the ignition point of a combination of aluminum and cupric oxide is about 1200 degrees Fahrenheit. Other thermite combinations can have an ignition point as low as 900 degrees Fahrenheit.

When ignited, the thermite produces an exothermic reaction. The rate of the thermite reaction occurs on the order of milliseconds, while an explosive reaction has a rate occurring on the order of nanoseconds. While explosive reactions can create detrimental explosive shockwaves within a wellbore, the use of a thermite-based power charge avoids such shockwaves (e.g., a deflagration or non-explosive reaction).

The thermite mixture can include a polymer, which can be disposed in association with, or as a part of, the thermite combination, wherein the polymer can be of a type that produces gas responsive to the thermite reaction. Usable polymers can include, without limitation, polyethylene, polypropylene, polystyrene, polyester, polyurethane, acetal, nylon, polycarbonate, vinyl, acrylin, acrylonitrile butadiene styrene, polyimide, cylic olefin copolymer, polyphenylene sulfide, polytetrafluroethylene, polyketone, polyetheretherketone, polytherlmide, polyethersulfone, polyamide imide, styrene acrylonitrile, cellulose propionate, diallyl phthalate, melamine formaldehyde, other similar polymers, or combinations thereof.

In an embodiment of the invention, the polymer can take the shape of a container, disposed exterior to and at least partially enclosing the thermite combination. Other associations between the polymer and thermite are also usable, such as substantially mixing the polymer with the thermite, or otherwise combining the polymer and thermite such that the polymer produces gas responsive to the thermite reaction. For example, a usable polymer can be included within a thermite mixture as a binding agent.

Once the exothermic reaction occurs, the fuel 34 (e.g., thermite, a thermite combination, or other fuel that produces an exothermic reaction) may pass through openings 36 that erode, melt, disintegrate, or destroy parts of the wellbore 16, casing 22, downhole tool 10, or other component(s) within the operation location 24. Furthermore, in certain embodiments, the fuel 34 may be activated, become molten, and then be forced through nozzles 38 located at an end of the fuel-storage body 32. The nozzles 38 may alter (e.g., restrict) the flow of the molten fuel, thus altering (e.g., increasing) the pressure, speed, and force of penetration into the component meant for annihilation. In certain embodiments, the molten fuel 34 may be used to pressurize one or more cavities of the downhole tool 10, forcing a piston or other object to move and do work within the operation location 24.

To activate the burn of the fuel 34, the pressure-initiated activator 30 may be configured to activate at a specific pressure conveyed through the tubing string 4. To pressurize the tubing string 4, the rig 12 pumps in fluid from the surface 14. Rather than pump all the fluid necessary to fill the entirety of the interior of the tubing string 4, the tubing string coupling 6 can include a first flow passage 40, as shown in FIG. 2, that enables the fluid 20 from the wellbore 16 to enter the tubing string 4 as the tubing string 4 is lowered into the wellbore 16.

Figure 3:
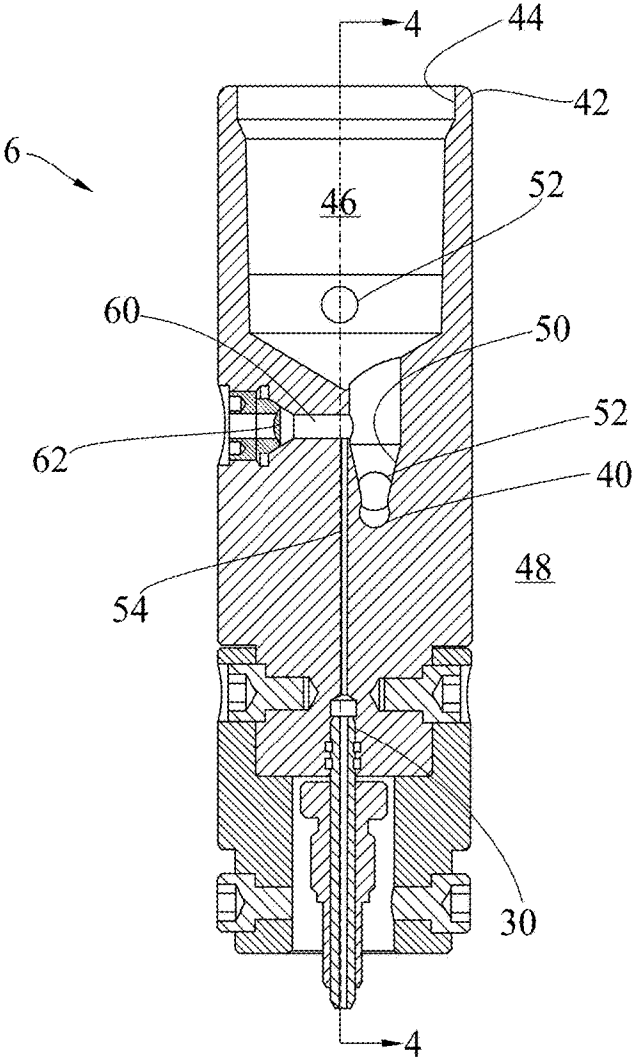
FIG. 3 illustrates a cross-sectional side view of an embodiment of the coupling that may be used between the downhole tool and the tubing string.

FIG. 3 illustrates a cross-sectional side view of an embodiment of the tubing string coupling 6 that may be used between the downhole tool 10 and the tubing string 4. In the illustrated embodiment, a top portion 42 of the tubing string coupling 6 may include connection or attachment structures 44, such as threads, clasps, brackets or other fasteners and ways to attach the tubing string coupling 6 to the bottom end of the tubing string 4. Once attached, an interior 46 of the tubing string coupling 6 can have approximately the same internal pressure as the tubing string 4. The pressure can be increased at the bottom of the tubing string 4 due to the gravitational force of the fluid 20 within the tubing string 4, of course.

As mentioned above, lowering the downhole tool 10 through the fluid 20, and later pressurizing the interior 46, would necessitate pumping fluid into the tubing string 4 if not for the first flow passage 40. However, with this feature of the first flow passage 40, such pumping of the fluid into the tubing string 4 is not needed for operation of the system.

In a wellbore 16 that is several thousand feet deep, the amount of fluid required to pressurize the tubing string 4 would be difficult to store, pump, and/or acquire. Allowing the fluid 20 to enter into the interior 46, from an exterior 48 of the tubing string coupling 6, through the first flow passage 40 alleviates the need for so much fluid. Once the downhole tool 10 is in place, however, if the first flow passage 40 remained open, added fluid would be jetted into the exterior 48 of the tubing string coupling 6. The jetting of fluid prevents pressurizing of the interior 46. To enable the fluid to pressurize, the tubing string coupling 6 includes a stopper seat 50 that can be configured to hold a stopper 52. The stopper 52 may include a variety of materials; for example, the stopper 52 may be round, such as a ball, and made out of steel or other metal, rubber, polymer, ceramic, or other rigid or conformable material. The stopper 52 may also include various other shapes configured to fit within the stopper seat 50.

When the downhole tool 10 is located at the operation location 24, the stopper 52 can be dropped into the tubing string 4 by an operator at the surface 14, and can travel within the tubing string 4 until it reaches the stopper seat 50. In the event that gravity is not sufficient on its own to set the stopper 52 in place, the stopper 52 can be flushed into place by the fluid pumped from the surface 14. The stopper seat 50 and the stopper 52 are correspondingly shaped so that when the stopper 52 is seated in the stopper seat 50, the stopper 52 can block the flow through the first flow passage 40. Since there is no fluid flowing from the interior 46 to the exterior 48, fluid pumped into the tubing string 4 from the surface 14 can pressurize the interior 46 of the tubing string coupling 6.

The increase in the interior pressure reaches the pressure-initiated activator 30 through a pressure passage 54. As illustrated, the pressure passage 54 can open, for example, just next to the stopper seat 50 and connect downward to the pressure-initiated activator 30. Thus, as the operator pressurizes the interior 46, the pressure passage 54 conveys that pressure until the interior pressure reaches a threshold activation pressure. The activation pressure is determined by selection of the pressure-initiated activator 30 before the downhole tool 10 is sent into the wellbore 16. At the specific activation pressure, the pressure-initiated activator 30 activates the burn of the fuel 34 (e.g., heating a metal coil or other heating element to a temperature sufficient to activate the reaction of the thermite fuel 34). The activation does not result in an explosion, nor is there an explosive charge that starts the burning of the fuel 34.

Depending on the type of operation conducted by the downhole tool 10, the operator may be able to confirm when the operation is finished. In other embodiments, the operator may wait a specified time after the activation pressure has been reached. After the operator determines that the operation is likely concluded, a retrieval procedure begins. As with the lowering of the downhole tool 10, the retrieval of the downhole tool 10 is easier when the fluid 20 within the tubing string 4 is left in the wellbore 16. With the stopper 52 blocking the first flow passage 40, the fluid needs to be evacuated through a second flow passage 60 that, up until this point in the operation, has been blocked by a burst disc 62.

The burst disc 62 seals the second flow passage 60, but is configured to break and dislodge from the second flow passage 60 when exposed to a burst pressure. The burst pressure is determined to be higher than the activation pressure to ensure that the pressure-initiated activator 30 activates the burn of the fuel 34 before the burst disc 62 breaks. Once the burst disc 62 is broken, fluid is free to pass from the interior 46 of the tubing string coupling 6 to the exterior 48 of the tubing string coupling 6, or, technically, vice versa. The tubing string 4 and the downhole tool 10 may then be retrieved by the rig 12 at the surface 14. As the tubing string 4 is retrieved, the fluid within the interior 46 of the tubing string coupling 6 exits through the second flow passage 60, such that when the coupling 6 and the downhole tool 10 reach the surface 14, none of the fluid remains within.

Figure 4:
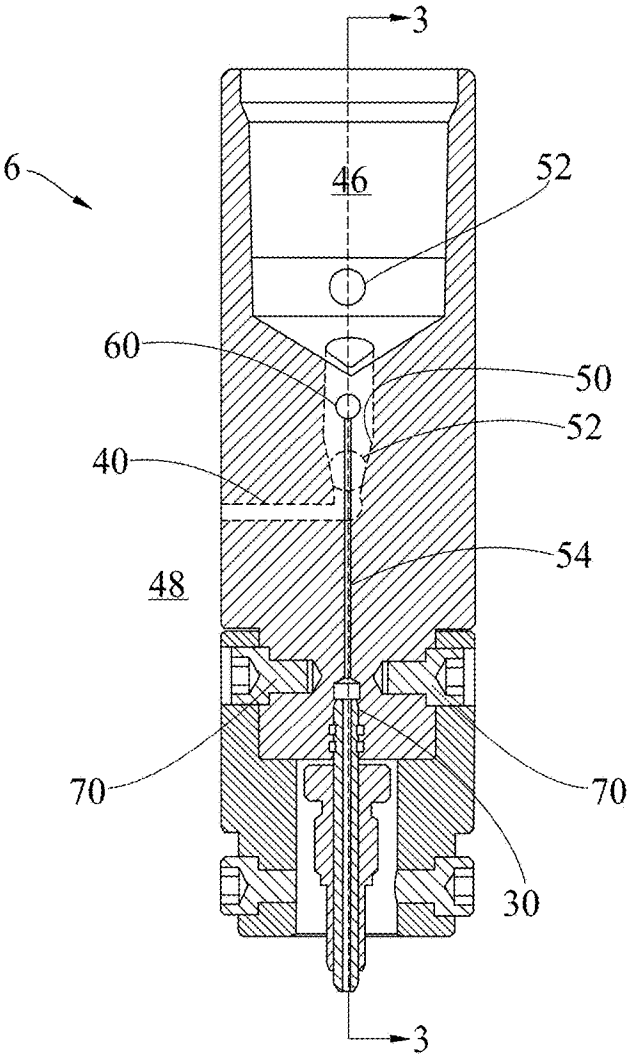
FIG. 4 illustrates a cross-sectional side view of the embodiment of the coupling illustrated in FIG. 3.

FIG. 4 illustrates a cross-sectional side view of the embodiment of the tubing string coupling 6 illustrated in FIG. 3. The cross-sectional view is indicated in FIG. 3 along the line 4-4. FIG. 4 also illustrates the cross-sectional view of FIG. 3 along the line 3-3. In FIG. 4, the stopper 52 is sealed in place within the stopper seat 50, blocking the first flow passage 40. The second flow passage 62 is shown flowing straight out to the exterior 48, and as with FIG. 3, the pressure passage 54 is shown connecting the interior 46 to the pressure-initiated activator 30. FIG. 4 also illustrates connectors 70 that can enable quick dismantling and replacement of the pressure-initiated activator 30 for redeployment into the wellbore 16. That is, the connectors 70 can be unscrewed or otherwise disconnected from the tubing string coupling 6, allowing access to the pressure-initiated activator 30. When the pressure-initiated activator 30 is replaced, and the stopper 52 is retrieved, the downhole tool 10 and the tubing string coupling 6 are ready to be deployed down the wellbore 16 again.

Thus, as described above, the tubing string coupling 6 is useful for enabling the pressurized activation of a downhole tool 10 having a fuel that, when ignited, produces an exothermic (non-explosive) reaction. The tubing string coupling 6 enables fluid 20 to flow into the interior 46 of the tubing string coupling 6 through a first flow passage 40 during descent of the downhole tool 10. And, with the use of a stopper 52, the interior 46 of the tubing string coupling 6 is pressurized to an activation pressure, which causes the pressure-initiated activator 30 to activate a burn within the downhole tool 10. Once the downhole tool 10 completes the operation, the interior 46 may be further pressurized to burst a burst disc 62, which opens the second flow passage 60. The second flow passage 60 enables the fluid 20 within the interior 46 to flow back out to the exterior 48 of the tubing string coupling 6, while the downhole tool 10 and the tubing string coupling 6 are raised to the surface 14.

While various embodiments usable within the scope of the present disclosure have been described with emphasis, it should be understood that within the scope of the appended claims, the present invention can be practiced other than as specifically described herein.

What is claimed is:

1. A coupling for connecting a downhole tool to a tubing string such that the downhole tool can be conveyed within a wellbore via the tubing string, wherein the coupling comprises:

an internal cavity configured to fluidly connect with an internal fluid passage of the tubing string when the coupling is connected with tubing string;

a first fluid passage extending between the internal cavity and the wellbore on an exterior of the coupling thereby fluidly connecting the internal cavity with the wellbore when the downhole tool is conveyed within the wellbore;

a stopper and stopper seat disposed along the first fluid passage, wherein the stopper seat is offset from a central axis of the coupling, wherein the stopper seat is configured to hold the stopper, and wherein the stopper is configured to be passed through the internal fluid passage of the tubing string and be seated in the stopper seat to block the first fluid passage to thereby fluidly disconnect the internal cavity from the wellbore;

a second fluid passage extending between the internal cavity and the wellbore on the exterior of the coupling thereby fluidly connecting the internal cavity with the wellbore;

a fluid blocking member disposed along the second fluid passage, wherein the fluid blocking member blocks the second fluid passage; and a third fluid passage fluidly connected with the internal cavity and configured to fluidly connect the internal cavity with the downhole tool when the coupling is connected with the downhole tool.

2. The coupling of claim 1, wherein the tubing string comprises at least one of: coiled tubing and a tubular joint string.

3. The coupling of claim 1, wherein the downhole tool comprises at least one of: a thermal perforating tool, a thermal cutting tool, a downhole torch, a downhole plug, a downhole packer, and a setting tool.

4. The coupling of claim 1, wherein:

the downhole tool comprises a pressure-initiated activator and a fuel;

the fuel comprises at least one of: a thermite and a thermite mixture;

the internal cavity is configured to receive internal pressure from the internal fluid passage when the coupling is connected with tubing string;

the third fluid passage is configured to communicate the internal pressure from the internal cavity to the pressure-initiated activator when the coupling is connected with the downhole tool; and the pressure-initiated activator is configured to activate an exothermic reaction of the fuel when the internal pressure reaches a predetermined pressure.

5. The coupling of claim 4, wherein:

the predetermined pressure is a first predetermined pressure;

the second fluid passage is configured to communicate the internal pressure from the internal cavity to the fluid blocking member; and the fluid blocking member is configured to unblock the second flow passage when the internal pressure reaches a second predetermined pressure thereby fluidly connecting the internal cavity with the wellbore; and the second predetermined pressure is higher than the first predetermined pressure.

6. The coupling of claim 4, wherein:

the predetermined pressure is a first predetermined pressure;

the fluid blocking member comprises a burst disc;

the second fluid passage is configured to communicate the internal pressure from the internal cavity to the burst disc; and the burst disc is configured to rupture to thereby unblock the second flow passage when the internal pressure reaches a second predetermined pressure thereby fluidly connecting the internal cavity with the wellbore; and the second predetermined pressure is higher than the first predetermined pressure.

7. A system for conveying and activating a downhole tool within a wellbore via a tubing string, wherein the system comprises:

a coupling configured for connection between the tubing string and the downhole tool, wherein the coupling comprises:

an internal cavity configured to fluidly connect with and receive internal pressure from an internal fluid passage of the tubing string when the coupling is connected with tubing string;

a first fluid passage extending between the internal cavity and the wellbore on an exterior of the coupling thereby fluidly connecting the internal cavity with the wellbore when the downhole tool is conveyed within the wellbore;

a stopper and stopper seat disposed along the first fluid passage, wherein the stopper seat is offset from a central axis of the coupling, wherein the stopper seat is configured to hold the stopper, and wherein the stopper is configured to be passed through the internal fluid passage of the tubing string and be seated in the stopper seat to block the first fluid passage to thereby fluidly disconnect the internal cavity from the wellbore;

a second fluid passage extending between the internal cavity and the wellbore on the exterior of the coupling thereby fluidly connecting the internal cavity with the wellbore;

a fluid blocking member disposed along the second fluid passage, wherein the fluid blocking member blocks the second fluid passage; and a third fluid passage fluidly connected with the internal cavity; and an activator connected to the coupling, wherein:

the third fluid passage fluidly connects the internal cavity with the activator;

the third fluid passage is configured to communicate the internal pressure from the internal cavity to the activator; and the activator is configured to activate the downhole tool when the internal pressure reaches a predetermined pressure.

8. The system of claim 7, wherein the tubing string comprises at least one of: coiled tubing and a tubular joint string, and wherein the downhole tool comprises at least one of: a thermal perforating tool, a thermal cutting tool, a downhole torch, a downhole plug, a downhole packer, and a setting tool.

9. The system of claim 7, wherein:

the downhole tool comprises a fuel;

the fuel comprises at least one of: a thermite and a thermite mixture; and the activator is configured to activate an exothermic reaction of the fuel when the internal pressure reaches the predetermined pressure.

10. The system of claim 7, wherein:

the predetermined pressure is a first predetermined pressure;

the second fluid passage is configured to communicate the internal pressure from the internal cavity to the fluid blocking member;

the fluid blocking member is configured to unblock the second flow passage when the internal pressure reaches a second predetermined pressure thereby fluidly connecting the internal cavity with the wellbore; and the second predetermined pressure is higher than the first predetermined pressure.

11. A method comprising:

connecting a coupling between a downhole tool and a lower end of a tubing string such that an internal cavity of the coupling is fluidly connected with an internal fluid passage of the tubing string and a pressure passage of the coupling is fluidly connected with the downhole tool, wherein the internal cavity and the pressure passage are fluidly connected;

lowering the downhole tool within the wellbore via the tubing string thereby causing a fluid to flow from the wellbore into the tubing string via a first fluid passage of the coupling, wherein the first fluid passage extends between the internal cavity and an exterior of the coupling;

blocking the first fluid passage to fluidly disconnect the internal cavity from the wellbore;

pressurizing the fluid within the internal fluid passage of the tubing string to increase pressure within the internal cavity to:

a first pressure to cause operation of the downhole tool; and then a second pressure to cause operation of a fluid blocking member, wherein the second pressure is higher than the first pressure, wherein the fluid blocking member is disposed along a second fluid passage extending between the internal cavity and the exterior of the coupling, wherein the fluid blocking member blocks the second fluid passage, and wherein the operation of the fluid blocking member comprises unblocking the second fluid passage to fluidly connect the internal cavity with the wellbore; and raising the downhole tool within the wellbore via the tubing string thereby causing the fluid to flow out of the tubing string into the wellbore via the second fluid passage.

12. The method of claim 11, wherein the tubing string comprises at least one of: coiled tubing and a tubular joint string, and wherein the downhole tool comprises at least one of: a thermal perforating tool, a thermal cutting tool, a downhole torch, a downhole plug, a downhole packer, and a setting tool.

13. The method of claim 11, wherein:

the downhole tool comprises an activator and a fuel;

the fuel comprises at least one of: a thermite and a thermite mixture; and wherein the operation of the downhole tool comprises activating an exothermic reaction of the thermite with the activator.

14. The method of claim 11, wherein the fluid blocking member comprises a burst disc, and wherein the operation of the fluid blocking member comprises rupturing of the burst disc.

15. The method of claim 11, wherein blocking the first fluid passage comprises passing a stopper from a wellsite surface through the internal passage of the tubing string and through the internal cavity to a stopper seat along the first fluid passage to block the first fluid passage.

16. The method of claim 15, wherein the stopper seat is offset from a central axis of the coupling.

* * * * *